US005250916A

United States Patent [19]

Zakman

[11] Patent Number: 5,250,916

[45] Date of Patent: Oct. 5, 1993

[54] MULTI-PASSBAND DIELECTRIC FILTER CONSTRUCTION HAVING FILTER PORTIONS WITH DISSIMILARLY-SIZED RESONATORS

[75] Inventor: Zdravko M. Zakman, Schaumburg, Ill.

[73] Assignee: Motorola, Inc., Schaumburg, Ill.

[21] Appl. No.: 876,607

[22] Filed: Apr. 30, 1992

[51] Int. Cl.[5] ..... H01P 1/205

[52] U.S. Cl. ..... 333/206; 333/134

[58] Field of Search ..... 333/134, 202, 206, 207, 333/222; 455/78-83

[56] References Cited

U.S. PATENT DOCUMENTS

| | | | |
|---|---|---|---|
| 4,733,208 | 3/1988 | Ishikawa et al. | 333/206 X |
| 4,742,562 | 5/1988 | Kommrusch | 333/202 X |
| 4,879,533 | 11/1989 | de Muro et al. | 333/202 X |
| 4,954,796 | 9/1990 | Green et al. | 333/202 X |

*Primary Examiner*—Robert J. Pascal
*Assistant Examiner*—Seung Ham
*Attorney, Agent, or Firm*—Robert H. Kelly

[57] ABSTRACT

A filter duplexer, such as a filter duplexer for a radio transceiver, of minimum dimensions is disclosed. A first filter portion of the duplexer filter includes resonators of a first geometric configuration, and a second filter circuit portion of the duplexer filter comprises resonators of a second geometric configuration. The geometric configuration of the two filter circuit portions are dissimilar such that relative characteristic admittances of the resonators of the respective filter circuit portions are dissimilar. Because the resonators of the two filter circuit portions are of dissimilar electrical characteristics, a desired frequency response of the duplexer filter may be obtained with similar resonator loading capacitances.

19 Claims, 4 Drawing Sheets

MULTI-PASSBAND DIELECTRIC FILTER CONSTRUCTION HAVING FILTER PORTIONS WITH DISSIMILARLY-SIZED RESONATORS

BACKGROUND OF THE INVENTION

The present invention relates generally to dielectric filters, and, more particularly, to a multi-passband, dielectric filter, such as a duplexer filter, of a design which minimizes the physical dimensions thereof.

Advancements in the field of radio electronics have permitted the introduction and commercialization of an ever-increasing array of radio communication apparatus. Advancements in electronic circuitry design have also permitted increased miniaturization of the electronic circuitry comprising such radio communication apparatus. As a result, an ever-increasing array of radio communication apparatus comprised of ever-smaller, electronic circuitry has permitted the radio communication apparatus to be utilized more conveniently in an increased number of applications.

A radio transceiver, such as a radiotelephone utilized in a cellular, communication system, is one example of radio communication apparatus which has been miniaturized to be utilized conveniently in an increased number of applications. Additional efforts to miniaturize further the electronic circuitry of such radio transceivers, as well as other radio communication apparatus, are being made. Such further miniaturization of the radio transceivers will further increase the convenience of utilization of such apparatus, and will permit such apparatus to be utilized in further increased numbers of applications.

Pursuant to such efforts to miniaturize further the electronic circuitry comprising radio transceivers, as well as other radio communication apparatus, size minimization of the electronic circuitry comprising such is a critical design goal during circuit design.

Dielectric block filters, comprised of a ceramic material, frequently comprise a portion of the circuitry of such radio transceivers. Such dielectric block filters are advantageously utilized for reasons of cost, simplicity of manufacture, ease of installation upon an electrical circuit board, and good filter characteristics at frequencies (typically in the 900 Megahertz and 1.7 Gigahertz range) at which such transceivers usually are operative.

To form a filter of a block of dielectric material, holes are bored, or otherwise formed, to extend through the dielectric block, and sidewalls defining such holes are coated with an electrically-conductive material, such as a silver-containing material. The holes formed thereby form resonators which resonate at frequencies determined by the lengths of the holes.

Typically, substantial portions of the outer surfaces of the dielectric block are similarly coated with the electrically-conductive material. Such portions of the outer surfaces are typically coupled to an electrical ground.

Spaced-apart portions of a top surface of the dielectric block are also typically coated with the electrically-conductive material which is electrically isolated from the electrically-conductive material coated upon other outer surfaces of the dielectric block. Adjacent portions of the electrically-conductive material coated upon the top surface become capacitively coupled theretogether. Additionally, such portions capacitively load respective ones of the resonators.

The resonators, due to electromagnetic intercoupling between adjacent ones of the resonators, the portions of the top surface of the block due to capacitive coupling, and the capacitive loading of the resonators together define a filter having filter characteristics for filtering a signal applied thereto.

The precise filter characteristics of such a filter can be controlled by controlling the capacitive intercouplings (and, hence, capacitive values of the capacitive elements formed thereof) and the spacing between adjacent ones of the resonators (and, hence, inductive values of the inductive elements formed thereof).

Historically, the component value of the elements comprising such a filter, and, hence, the filter characteristics of the filter formed therefrom, have been controlled in two ways. First, the capacitive values of the capacitive elements formed upon the top surface of the dielectric block have been altered, and, second, the spacings between the adjacent ones of the resonators have been altered.

Alteration of the capacitive values of the capacitive elements formed upon the top surface of the dielectric block is becoming a less viable means of altering the filter characteristics of a dielectric filter as the physical dimensions of such filters are reduced. The capacitive values of such capacitive elements are dependent upon the physical dimensions of the coated areas forming such elements as well as spacings between the coated areas which form the capacitive elements.

As the physical dimensions of the filters are reduced, the physical dimensions of the coated areas which form the capacitive elements must be correspondingly reduced. For such capacitive elements to maintain the same capacitance (as capacitance is directly proportional to surface area, and inversely proportional to distance), the spacings between the coated areas must be reduced.

However, for manufacturing reasons, a minimum spacing is required between the coated areas. Accordingly, alteration of the filter characteristics of such a filter constructed in such manner has become increasingly limited.

Duplexer filters are one such type of dielectric filter commonly utilized to form portions of the circuitry of a radio transceiver. Typically, a duplexer filter is connected between an antenna of the radio transceiver and both the transmitter circuitry and receiver circuitry portions thereof. The duplexer filter comprises a receive portion of a first passband centered about a first center frequency, and a transmit filter portion having a second passband centered about a second center frequency. The first passband of the receive filter portion, and the second passband of the transmit filter portions of the duplexer filter are of passbands of non-overlapping frequencies. Both the receive filter portion and the transmit filter portion are connected to a common antenna; the receive filter portion is coupled to the receiver circuitry of the radio transceiver, while the transmit filter portion is connected to the transmitter circuitry portion of the radio transceiver.

Reductions in the physical dimensions of duplexer filters responsive to increased miniaturization of radio transceivers is limited by the constraints noted hereinabove.

Accordingly, what is needed is a multi-passband filter construction, and means for making such, to be of reduced physical dimensions.

SUMMARY OF THE INVENTION

The present invention, accordingly, overcomes the limitations of the existing art to permit a duplexer filter to be constructed of reduced physical dimensions.

The present invention further advantageously provides a duplexer filter construction of minimal physical dimensions.

The present invention includes further advantages and features, the details of which will become more apparent by reading the detailed description of the preferred embodiments hereinbelow.

In accordance with the present invention, therefore, a multi-passband filter construction formed of a dielectric block defining top, bottom, and at least first and second side surfaces, is disclosed. The filter construction comprises a first filter circuit portion for generating a first filtered signal responsive to application of a first input signal thereto. The first filter circuit portion is formed of at least one resonator of a cross-sectional area of a first configuration and is formed to extend essentially-longitudinally along a longitudinal axis thereof between the top and bottom surfaces of the dielectric block. A second filter circuit portion generates a second filtered signal responsive to application of a second input signal thereto. The second filter circuit portion is formed of at least one resonator of a cross-sectional area of a second configuration, and is formed to extend essential longitudinally along a longitudinal axis thereof between the top and bottom surfaces of the dielectric block. The cross-sectional area of the second configuration is of a geometry dissimilar with that of the cross-sectional area of the first configuration.

BRIEF DESCRIPTION OF THE DRAWINGS

The present invention will be better understood when read in light of the accompanying drawings in which:

FIG. 8 is a plan view of yet another alternate, preferred embodiment of the present invention;

DESCRIPTION OF THE PREFERRED EMBODIMENTS

Figure 1:
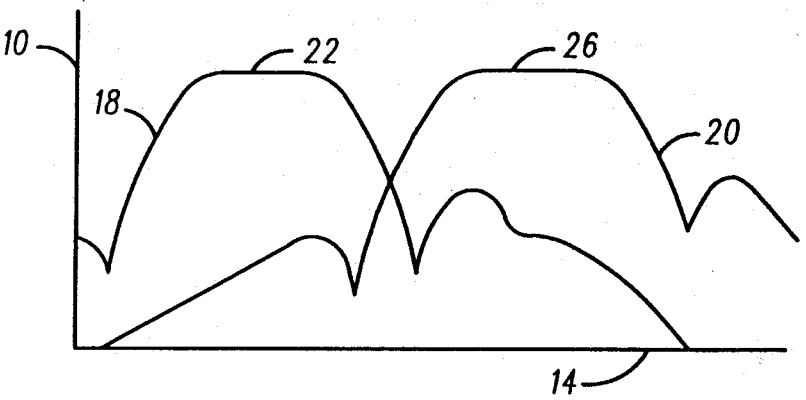
FIG. 1 is a graphical representation of the frequency response of a duplexer filter of a preferred embodiment of the present invention.

Turning first to the graphical representation of FIG. 1, the frequency response of a duplexer filter is graphically represented. Ordinate axis 10 is scaled in terms of a power-related value, here decibels, and abscissa axis 14 is scaled in terms of frequency. Curve 18 is a plot of the frequency response of a first filter portion of the duplexer filter (between a common port and a first input port of the duplexer filter). Curve 20 is a plot of the frequency response of a second filter portion of the duplexer filter (between the common port and a second input port of the duplexer filter). The frequency response of the first filter portion defines passband 22, and the frequency response of the second filter portion defines passband 26. Passbands 22 and 26 are spaced-apart in frequency to be of non-overlapping passband frequencies.

As noted hereinabove, duplexer filters are advantageously utilized to form portions of a two-way radio transceiver in substitution for separate, individual receive and transmit filters coupled to receiver and transmitter circuitry portions, respectively, of the transceiver. A duplexer filter, comprised of a monolithic block of dielectric material, exhibits a greater efficiency (i.e., is a low-loss device), and may be more inexpensively manufactured than can separate filters.

As the electronic devices of which duplexers typically form portions are increasingly reduced in physical dimensions, the physical dimensions of such duplexers, correspondingly, also are being reduced. Reducing the physical dimensions of the duplexer filter can be accomplished in several different manners. For instance, the dielectric material of which the duplexer is comprised may be altered. However, substitution of different dielectric materials to increase the relative dielectric constant of such material is limited by the availability and cost of material compositions with both good electrical and good mechanical characteristics, and is, accordingly, oftentimes an impractical means by which to reduce the physical dimensions of the filter.

The capacitive loading, formed by capacitive elements comprised of capacitive plates painted upon surfaces of the duplexer filter, may be increased thereby allowing shortening of the resonators. However, for manufacturing reasons, the spacings between the plates of the capacitive elements cannot be reduced beyond minimum distances. Such minimum spacing requirements limits the reduction in physical dimensions of the duplexer filter.

Accordingly, additional reduction in the physical dimensions of monolithic, duplexer filters by altering the capacitive values of capacitive elements formed upon the filters or by using alternate dielectric materials to form the duplexer filter is limited.

Figure 2:
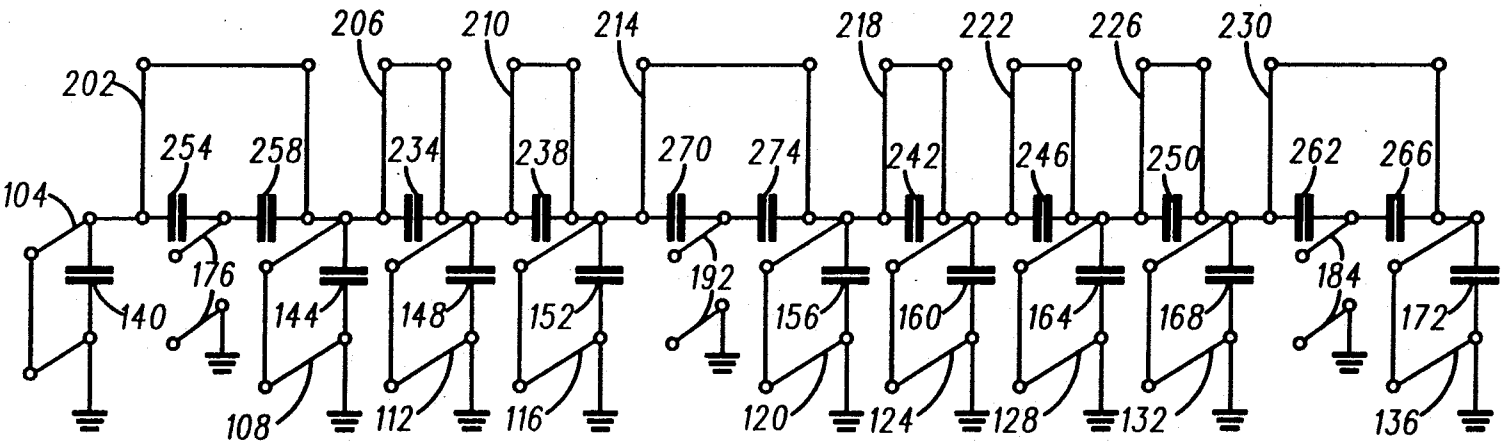
FIG. 2 is an electrical schematic of a duplexer filter of a preferred embodiment of the present invention.

Turning next to the electrical schematic of FIG. 2, a circuit diagram of duplexer filter, here referred to generally by reference numeral 80, is shown. Filter 80 illustrates a multi-pole duplexer filter constructed to have a frequency response with passbands at frequencies at which radio transceivers operative in a cellular, communication system are operative to transmit and to receive modulated signals.

It is to be noted at the outset that filter 80 is representative of an exemplary embodiment of the present invention; many other duplexers of other circuit configurations, and other single- and multi-pole, filter circuits may be constructed according to the teachings of the preferred embodiments of the present invention.

Filter 80 of FIG. 2 includes a plurality of resonators, here designated by transmission lines 104, 108, 112, 116, 120, 124, 128, 132, and 136. Resonators represented by transmission lines 104–136 are each capacitively loaded by capacitors 140, 144, 148, 152, 156, 160, 164, 168, and 172 to an electrical ground plane.

Adjacent ones of the resonators (represented by transmission lines 104–136) are both inductively coupled and capacitively coupled to adjacent ones of the resonators. A first filter portion of filter 80 includes the resonators represented at the left-hand side of filter 80, and a second filter portion of the filter 80 is comprised of resonators formed at the right-hand side portion of the figure. Input terminals of the first filter portion are indicated in the figure by transmission line 176. Similarly, input terminals of the second filter portion are indicated in the figure by transmission line 184. The first filter portion and the second filter portion are commonly connected to a single antenna at terminals indicated by transmission line 192.

Transmission line 104 is configured to form a filter-transfer function zero, and transmission lines 108–116 are configured to form filter-transfer function poles of the first filter portion. Similarly, transmission line 136 is configured to form a filter-transfer function zero, and transmission lines 120–132 are configured to form filter-transfer function poles of the second filter portion.

Individual ones of the resonators (represented by transmission lines 104–136) are inductively coupled to resonators adjacent thereto. In the figure, inductive coupling between resonators represented by transmission lines 104 and 108 is indicated in the figure by transmission line 202; similarly, inductive coupling between resonators represented by transmission lines 108 and 112 is indicated by transmission line 206; inductive coupling between resonators represented by transmission lines 112 and 116 is indicated by transmission line 210; inductive coupling between resonators represented by transmission lines 116 and 120 is indicated by transmission line 214; inductive coupling between resonators represented by transmission lines 120 and 124 is indicated by transmission line 218; inductive coupling between resonators represented by transmission lines 124 and 128 is indicated by transmission line 222; inductive coupling between resonators represented by transmission lines 128 and 132 is represented by transmission line 226; and, inductive coupling between resonators represented by transmission lines 132 and 136 is indicated by transmission line 230.

An electrically-conductive material coated upon the inner surfaces which define the inner conductors of the resonators of filter 80 (or formed upon a surface of the dielectric block, and electrically connected to such inner surfaces), are capacitively coupled to corresponding portions of adjacent ones of the resonators. In the figure, such capacitive coupling is indicated by capacitors 234, 238, 242, 246, and 250. Additionally, capacitors 254 and 258 represent input capacitances; capacitors 262 and 266 similarly represent input capacitances; and, capacitors 270 and 274 represent coupling capacitances to the antenna port.

As noted hereinabove, increasing the capacitive loading of the resonators to permit further reduction in the physical dimensions of a dielectric-block, duplexer filter, is limited due to the requirement of minimum spacing between conductive elements of such capacitors. Such capacitive loadings are represented in the figure by capacitors 140-172.

Conventionally, the resonators of the filter, represented in the figure by transmission lines 104–136, are all similarly-sized. When the resonators are similarly-sized, the characteristic admittances of the individual resonators are all of similar values. Accordingly, by nodal analysis, a nodal admittance equation may be obtained. For instance, by isolating the node at which capacitors 164, 246, and 250, and transmission lines 128, 222, and 226 are all common, a nodal admittance equation may be obtained as follows:

$$j\omega_o(C_{164}+C_{250})-j(Y_{128}+Y_{222}+Y_{226})\cot\theta_o=0$$

where:

$C_{164}$ is the capacitance of capacitor 164

$C_{246}$ is the capacitance of capacitor 246;

$C_{250}$ is the capacitance of capacitor 250;

$Y_{128}$ is the even-mode admittance of transmission line 128;

$Y_{222}$ is the characteristic admittance of transmission line 222;

$Y_{226}$ is the characteristic admittance of transmission line 226;

$\omega_o$ is the angular frequency at the center of the passband of the filter;

$\theta_o$ is the electrical length of the transmission lines at $\omega_o$.

More generally, for any three adjacent resonators i, j, and k, of filter 80, the following nodal admittance equation may be obtained:

$$j\omega_o(C_j+C_{ij}+C_{jk})-j(Y_{ij}+Y_{jk})\cot\theta_o=0$$

where:

$Y_j$ is the even mode characteristic admittance of resonator j;

$C_j$ is the value of the capacitance between resonator j and a ground plane;

$Y_{ij}$ is the mutual characteristic admittance between resonators i and j;

$C_{ij}$ is the capacitive coupling between resonators i and j;

$Y_{jk}$ is the value of the mutual characteristic admittance between resonators j and k;

$C_{jk}$ is the capacitive coupling between resonators j and k;

$\omega_o$ is the angular frequency at the center of the passband of the filter; and $\theta_o$ is the electrical length of the transmission lines at $\omega_o$.

This generalized expression may be rearranged as follows:

$$C_j+C_{ij}+C_{jk}=(Y_j+Y_{jk})\cot\theta_o/\omega_o$$

As mentioned previously, the resonators of the first filter portion and of the second filter portion of a duplexer filter, such as filter 80, are conventionally, similarly-sized. When similarly-sized, the admittances of such resonators are similar. With respect to the above, generalized expression, $Y_j$, $Y_{ij}$, and $Y_{jk}$, and the summations thereof, are of similar values for both the first filter portion and the second filter portion.

A ratio between the capacitance of the second filter portion (i.e., $C_j+C_{ij}+C_{jk}$ of the second filter portion) to the combined capacitance of the first filter portion (i.e., $C_j+C_{ij}+C_{jk}$ of the first filter portion) is given as follows:

$$C_2/C_1=[f_1\tan(\theta_o f_1/f_o)]/[f_2\tan(\theta_o f_2/f_o)]$$

where:

$f_1$ and $f_2$ are the passband center frequencies of the two filter portions; and $f_o$ is the average of the two center frequencies.

Examination of this ratio (in which the admittances of the two filter portions are equal and cancel one another) indicates that the ratio between the nodal capacitive values of the two filter portions to obtain a desired frequency response of the duplexer filter can require combined, nodal capacitive values of the two filter portion of the duplexer filter to be of significantly different values. Realization of capacitive elements having capacitive values forming such ratios becomes impractical as the physical dimensions of the dielectric block filter are reduced.

The above ratio $C_2/C_1$, is obtained by assuming the resonators of the filter portions of the duplexer filter to be similarly-constructed to be thereby of similar admittance (and associated impedance) values. However, by altering the configurations of the resonators of the first and second filter portions, respectively, of the duplexer filter, the electrical characteristics of the respective resonators can be made to be of dissimilar electrical characteristics (namely, to be of dissimilar admittances). Accordingly, a ratio of the admittances of the first filter portion to the admittances of the second filter portion may be written as follows:

$$Y_2/Y_1=(C_2/C_1)\,(f_2/f_1)\,(\tan(\theta_o f_2/f_0)/\tan(\theta_o f_1/f_0)$$

where:

$C_2$ is the combined nodal capacitive value of the second filter portion;

$C_1$ is the combined nodal capacitive value of the first filter portion;

$f_2$ is the center frequency of the passband of the second filter portion;

$f_1$ is the center frequency of the passband of the first filter portion; and $f_o$ is the average of $f_2$ and $f_1$.

Accordingly, a desired frequency response of a duplexer filter may be obtained (without altering the resonator nodal capacitances—i.e., the sums of all capacitances of any node) by instead alterning the relative electrical characteristics of the transmission lines of the first filter portion and the second filter portion. Such alterations of the filter characteristics of the duplexer filter may be obtained by altering the geometric configurations of the resonators of the differing filter portions.

Figure 3:
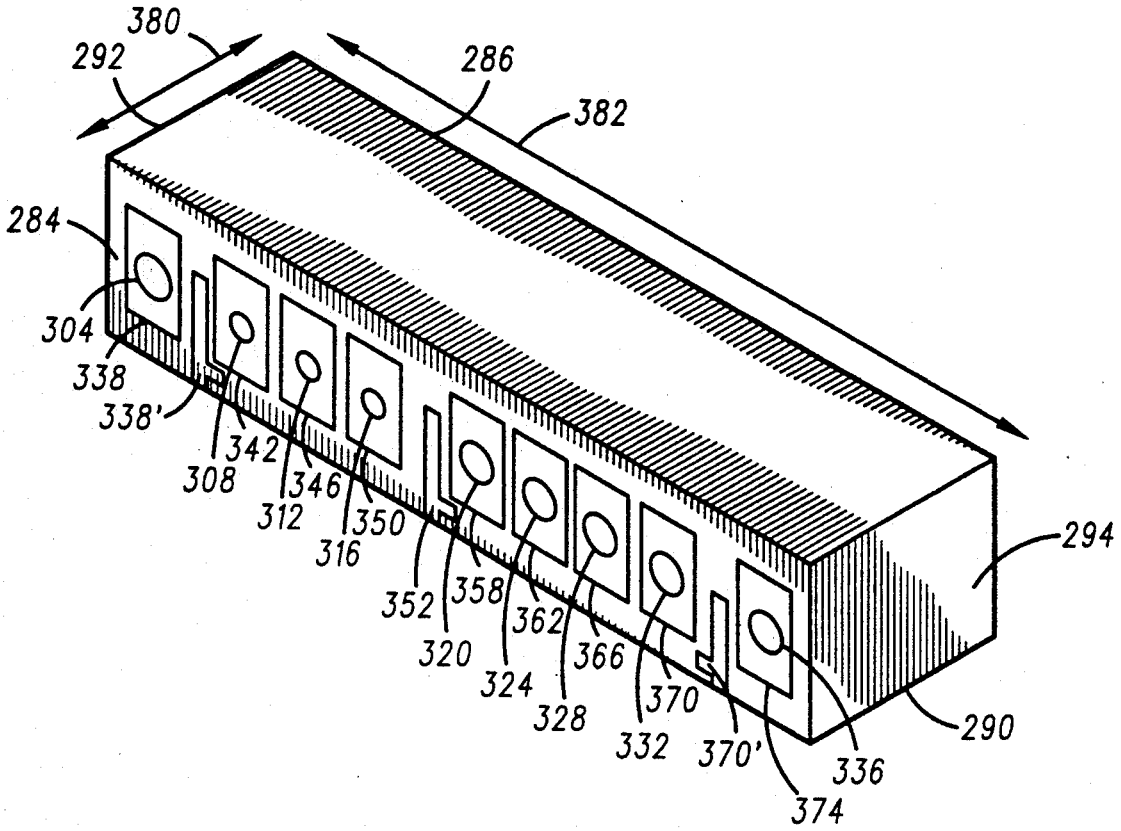
FIG. 3 is a perspective view of a duplexer filter of a preferred embodiment of the present invention, such as the filter shown in the circuit schematic of FIG. 2.

Turning next to the perspective view of FIG. 3, a duplexer filter, here referred to generally by reference numeral 280, of a first preferred embodiment of the present invention is shown. Filter 280 may be represented schematically by the circuit schematic of filter 80 of FIG. 2. Filter 280 is generally block-like in configuration, and is comprised of a dielectric material. Filter 280 defines top surface 284, bottom surface 286, first side surface 288, second side surface 290, front surface 292, and rear side surface 294. A coating of an electrically-conductive material, typically a silver-containing material, is applied to substantial portions of bottom surface 286, and side surfaces 288, 290, and 292. Such portions of the surfaces 286–292 are coupled to an electrical ground plane. (As will be noted with respect to FIG. 4 hereinbelow, the coating of the electrically-conductive material applied to second side surface 290 is applied in a manner to form first and second filter portion coupling and antenna coupling electrodes thereupon.)

Formed to extend longitudinally along longitudinal axes through the dielectric block by a process of molding or otherwise, are a series of transmission lines, here designated by reference numerals 304, 308, 312, 316, 320, 324, 328, 332, and 336. Transmission lines 304–336 correspond to transmission lines 104–136 of the circuit schematic of filter 80 of FIG. 2. Transmission lines 304–336 define openings upon top surface 284 of filter 280. The sidewalls defining transmission lines 304–336 are also coated with the same electrically-conductive material which coats outer surfaces of the dielectric block. It is noted that, as transmission lines 304–336 form resonating transmission lines, or, more simply "resonators," when signals of certain oscillating frequencies are applied thereto, the use of terms transmission line and resonators will, at times, be used interchangeably hereinbelow.

Portions of top surface 284 are also coated with the same electrically-conductive material which coats side surfaces of the dielectric block and sidewalls which define transmission lines 304–336. Such portions are indicated in the figure by painted areas 338, 338', 342, 346, 350, 352, 358, 362, 366, 370, 370', and 374. Painted areas 338–374 are spaced-apart from one another, and are thereby capacitively coupled theretogether. Painted areas 338 and 338', 338' and 342, 350 and 352, 352 and 358, 370 and 370', and 370' and 374 are also capacitively coupled theretogether. The amount of capacitive coupling is determined by the size of the painted areas as well as the separation distance between adjacent ones of the painted areas. Respective ones of the painted areas 338, 342, 346, 350, 358, 362, 366, 370, and 374 capacitively load the resonators to ground.

It is also noted that the configuration of the painted areas upon top surface 284 are for purposes of illustration only. Other configurations, typically more complex, are oftentimes painted upon top surfaces of actual filters.

The dimensions of filter 280 are typically defined in terms of a heighthwise dimension, indicated by line segment 380, a lengthwise dimension, indicated by line segment 382, and a ground plane separation distance, indicated by line segment 384.

The heighthwise dimension of the filter determines the length of resonating transmission lines 304–336 which extend longitudinally through the dielectric block. Such heighthwise dimension of the filter is typically essentially fixed, as the lengths of transmission lines 304–336 must be of lengths proportional to the wavelengths (in the dielectric block material) of oscillating signals applied to the filter portions of the filter to be passed thereby. (As wavelength is inversely proportional to frequency, the lengths of transmission lines 304–336 are also related, in inverse proportion, to the frequency of signals applied to the filter portions of the filter.) Transmission lines 304–336 only form resonating transmission lines when the lengths of such transmission lines are proportional to the wavelengths of signals applied thereto. Hence, the heighthwise dimension filter 280 is essentially fixed for any particular duplexer filter construction.

Dielectric filter 280 is typically mounted upon an electrical circuit board by positioning second side surface 290 upon the surface of the circuit board. Once mounted, the filter extends above the surface of such circuit board by a distance corresponding to the length of the ground plane separation distance, represented by line segment 384. As electronic devices typically contain several electrical circuit boards stacked upon one another, the ground plane separation distance defines the minimum heighthwise spacing between such stacked, electrical circuit boards. As increase in the dimensions of the ground plane separation distance would result in increased physical dimensions of a device incorporating such, the ground plane separation distance is also typically fixed to be of less than a maximum length.

Transmission lines 304, 308, 312, and 316 comprise the resonators of a first filter portion of the duplexer filter 280. Transmission lines 304 and 336 are configured to form filter-transfer function zeroes of the respective filter portions of filter 280, and transmission lines 308–316 and 320–332 are configured to form filter-transfer function poles of the respective filter portions. Transmission lines 320, 324, 328, 332, and 336 comprise the resonators of the second filter portion of duplexer filter 280. The cross-sectional areas of center conductors of all of the transmission lines 308–332 are circular; however, the diameters of the cross-sectional areas of transmission lines 308–316 of the first filter portion are smaller in dimension than corresponding diameters of cross-sections of transmission lines 320, 324, 328, and 332. Because of the dissimilar configuration of the transmission lines of the separate filter portions of filter 280, the electrical characteristics of such resonators, namely the admittances of the respective transmission lines, are dissimilar. By suitable selection of the ratios of the admittances of the transmission lines, and by proper selection of the geometric configuration of the transmission lines of the filter portions, the filter characteristics of the separate filter portions may be selected, as desired.

Figure 4:
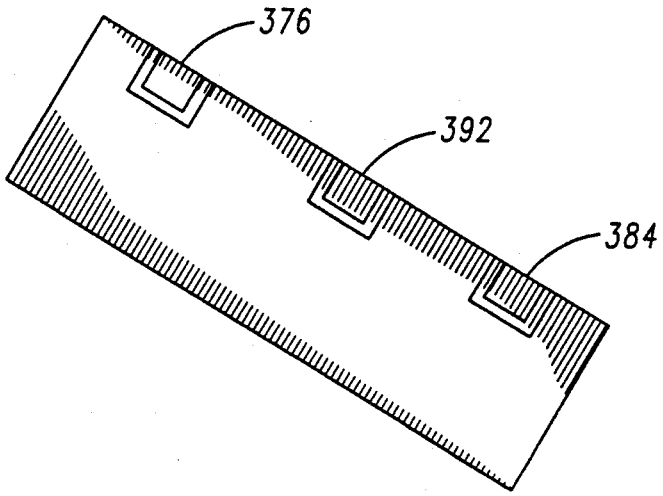
FIG. 4 is a bottom view taken from beneath a side surface of the filter of FIG. 3.

FIG. 4 is a view taken from beneath second side surface 290 of dielectric filter 280 of FIG. 3. As noted briefly hereinabove, the electrically-conductive material coated upon surface 290 is coated in a manner to form input coupling electrodes for each filter, and coupling electrodes for common connection of both filter portions to an antenna. The bottom view of FIG. 4 illustrates input couplers 376 and 384 of first and second filter portions, respectively, of filter 280, and antenna coupler 392.

Figure 5:
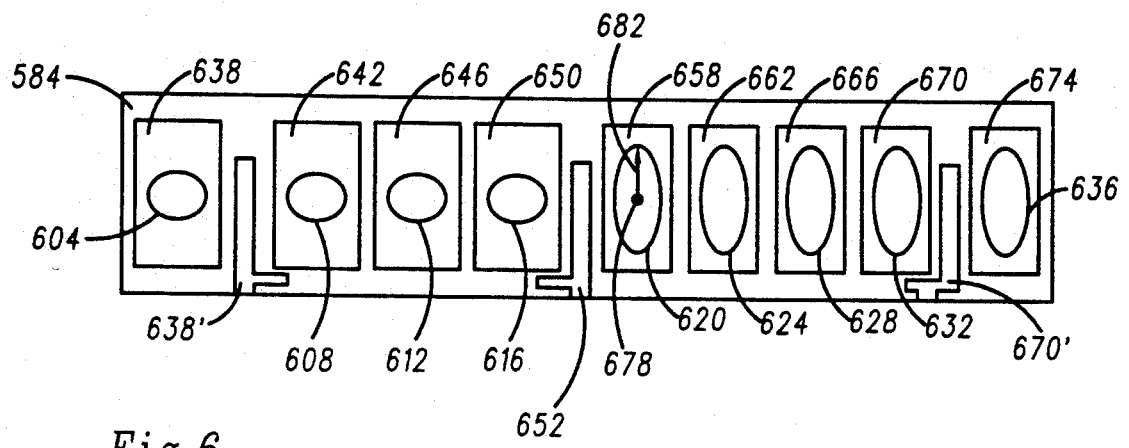
FIG. 5 is a plan view of a duplexer filter of an alternate, preferred embodiment of the present invention.

FIG. 5 is a plan view of a duplexer filter, here referred to generally by reference numeral 580, of an alternate, preferred embodiment of the present invention taken from above top surface 584 of the filter. Top surface 584 of filter 580 of FIG. 5 corresponds with top surface 284 of filter 280 of FIG. 3. Transmission lines 604, 608, 612, 616, 620, 624, 628, 632, and 636 extend along respective longitudinal axes thereof through duplexer filter 580 in manners analogous to corresponding formation of transmission lines 304–336 of filter 280 of FIG. 3. And, painted portions 638, 638', 642, 646, 650, 652, 658, 662, 666, 670, 670', and 674 are coated upon top surface 584 of duplexer filter 580. Adjacent ones of painted portions 638–674 are capacitively coupled to one another. Additionally, painted portions 638 and 638', 638' and 642, 650 and 652, 652 and 658, 670 and 670' and 670' and 674 are capacitively coupled to one another. Portions 638, 642, 646, 650, 658, 662, 666, 670, and 674 also capacitively load respective ones of the resonators.

Transmission lines 604, 608, 612, and 616 comprise the resonators of the first filter portion of duplexer filter 580; transmission lines 620, 624, 628, 632, and 636 comprise the resonators of the second filter portion of duplexer filter 580. Transmission lines 604 and 636 are configured to form filter-transfer function zeroes of the respective filter portions of filter 580, and transmission lines 608–616 and 620–632 are configured to form filter-transfer function poles of the respective filter portions. Cross-sectional areas of transmission lines 604–616 are dissimilar in geometric configuration with the cross-sectional areas of transmission lines 620–636 of the second filter portion of filter 580. Here, transmission lines 604–616 are of cross-sections which are circular in nature. However, cross-sections of transmission lines 620–636 are elongated in directions transverse to the longitudinal axes of the transmission lines. For instance, point 678 represents a longitudinal axis of transmission line 620. Line 682 represents the amount of elongation of the transmission line in a direction transverse to the direction of longitudinal axis 678.

Similar elongation of transverse axes of other of the transmission lines may be similarly shown. As the transmission lines of the first filter portion of duplexer 580 are dissimilar in geometric configuration with a transmission line of the second filter portion of the duplexer filter, the electrical characteristics, namely, the admittances, of the transmission lines of the respective filter portions differ. By appropriate selection of the relative dimensions of the transmission lines of the separate filter portions, a desired frequency response of the duplexer filter may be obtained.

Figure 6:
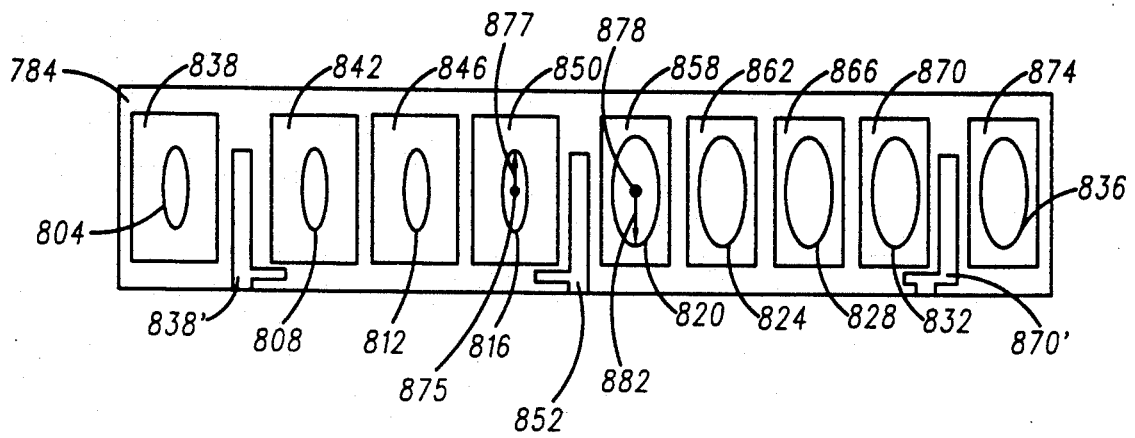
FIG. 6 is a plan view of another alternate, preferred embodiment of the present invention.

Turning next to the plan view of FIG. 6, a duplexer, here referred to generally by reference numeral 780, of another alternate, preferred embodiment of the present invention is shown, taken from above top surface 784 of the filter 780.

Transmission lines 804, 808, 812, 816, 820, 824, 828, 832, and 836 extend along respective longitudinal axes through the filter 780. Painted portions 838, 838', 842, 846, 850, 852, 858, 862, 866, 870, 870', and 874 of an electrically-conductive material are painted upon top surface 784. Adjacent painted portions 838–874 are capacitively coupled theretogether.

Transmission lines 804, 808, 812, and 816 form the resonators of a first filter portion of duplexer filter 780. Transmission lines 820, 824, 828, 832, and 836 form the resonators of a second filter portion of duplexer filter 780. Transmission lines 804 and 836 are configured to form filter-transfer function zeroes of the respective filter portions of filter 780, and transmission lines 808–816 and 820–832 are configured to form filter-transfer function poles of the respective filter portions. The cross-sectional areas of transmission lines 804–816 are elongated in directions transverse to longitudinal axis of the respective transmission line. For instance, point 875 represents a longitudinal axis of transmission line 816. Line 877 represents the elongation of the transmission line in a direction transverse to the longitudinal axis 875. Similarly, cross-sectional areas of transmission lines 820–836 are also elongated in directions transverse to the longitudinal axis of the respective transmission line. For instance, point 878 represents a longitudinal axis of transmission line 820. Line 882 represents the elongation of the transmission line in a direction transverse to the longitudinal axis 878.

The amount of elongation in directions transverse to the longitudinal axis of transmission lines 804–816 is less than the amount of elongation in directions transverse to the longitudinal axis of transmission lines 820–836. Accordingly, the geometric configurations of the resonators of the respective filter portions of duplexer filter 780 differ, and the electrical characteristics of such transmission lines differ.

By appropriate selection of the precise dimensions of the transmission lines of the filter portions, a desired frequency response of each filter portion of duplexer filter 780 may be obtained.

Figure 7:
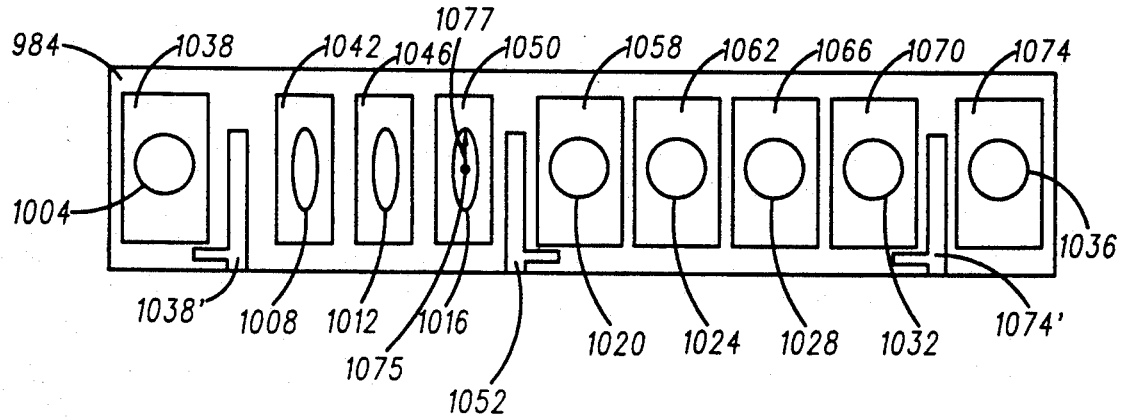
FIG. 7 is a plan view of still another alternate, preferred embodiment of the present invention.
Figure 7:
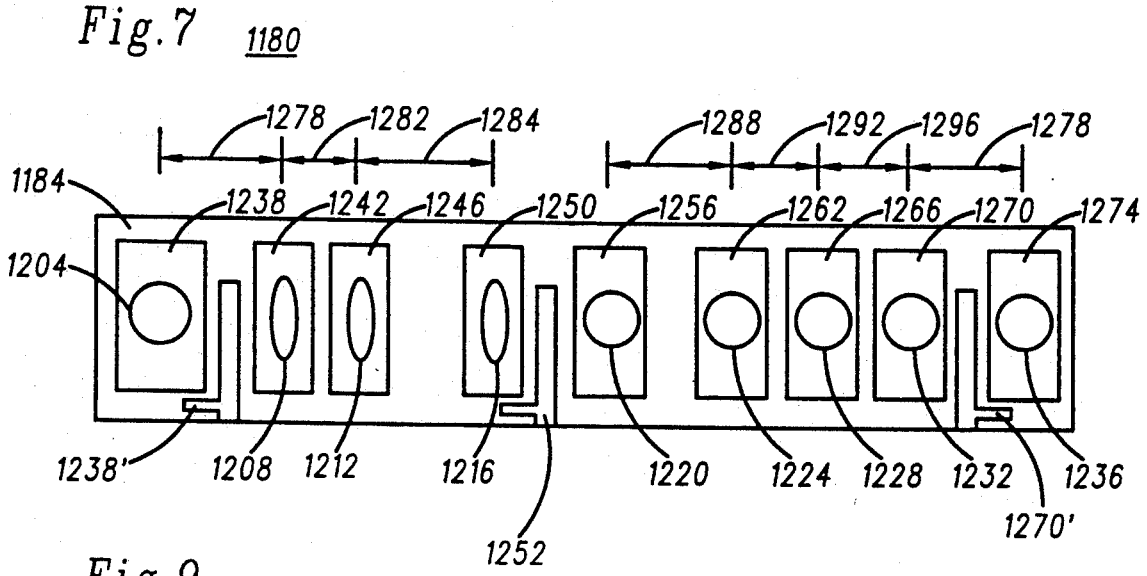

FIG. 7 is a plan view of a duplexer filter, here referred to generally by reference numeral 980, of another alternate, preferred embodiment of the present invention, taken from above top surface 984 thereof.

Duplexer filter 980 includes transmission lines 1004, 1008, 1012, 1016, 1020, 1024, 1028, 1032, and 1036 extending along longitudinal axes thereof through the duplexer filter. Painted portions 1038, 1038', 1042, 1046, 1050, 1052, 1058, 1062, 1066, 1070, 1070', and 1074 of an electrically-conductive material are painted upon top surface 984 of the duplexer filter. Adjacent ones of the painted portions are capacitively coupled to one another. Also painted areas 1038 and 1038', and painted areas 1070 and 1070' are also capacitively coupled to one another. Portions 1038, 1042, 1046, 1050, 1058, 1062, 1066, 1070, and 1074 also load respective ones of the resonators.

Transmission lines 1004, 1008, 1012, and 1016 comprise the resonators of a first filter portion of the duplexer filter; transmission lines 1020, 1024, 1028, 1032, and 1036 comprise the resonators of a second filter portion of the duplexer filter. Transmission lines 1004 and 1036 are configured to form filter-transfer function zeroes of the respective filter portions of filter 980, and transmission lines 1008–1016 and 1020–1032 are configured to form filter-transfer function poles of the respective filter portions.

Cross sections of transmission lines 1004–1016 of the first filter portion are dissimilar in geometric configuration with cross sectional areas of transmission lines 1020–1036 of the second filter portion. Here, the cross-sections of transmission lines 1004–1016 are elongated in directions transverse to longitudinal axes thereof. For instance, a longitudinal axis of transmission line 1016 is indicated by point 1075. Line 1077 represents the elongation in the direction transverse to the longitudinal axis 1075. The cross-sections of transmission lines 1020–1036 are circular.

Because the geometric configurations of transmission lines 1004–1016 of the first filter portion are dissimilar with the geometric configurations of transmission lines 1020–1036 of the second filter portion, the electrical characteristics of the transmission lines of the different filter portions, namely, the admittances thereof, differ. By appropriate selection of the dimensions of the transmission lines of the two filter portions, the desired electrical characteristics of the filter portions of the duplexer filter may be obtained.

FIG. 8 is a plan view of a duplexer filter, referred to generally by reference numeral 1180, of yet another alternate, preferred embodiment of the present invention, taken from above top surface 1184 thereof.

Duplexer filter 1180 includes transmission lines 1204, 1208, 1212, 1216, 1220, 1224, 1228, 1232, and 1236. Painted portions 1238, 1238', 1242, 1246, 1250, 1252, 1256, 1262, 1266, 1270, 1270', and 1274 are painted upon top surface 1184 whereby adjacent ones of the painted portions are capacitively coupled theretogether. Portions 1238, 1242 1246, 1250, 1256, 1262, 1266, 1270, and 1274 also load respective ones of the resonators.

Transmission lines 1204–1216 comprise the resonators of first filter portion, and transmission lines 1220–1236 comprise the resonators of a second filter portion of duplexer filter 1180. The transmission lines of duplexer filter 1180 are similar in dimensions with corresponding transmission lines of duplexer filter 980 of FIG. 7, and the details of such will not again be discussed.

The transmission lines 1204–1216 and 1220–1236 of duplexer filter 1180 are not equidistantly spaced. Instead, spacing between the transmission lines of the respective filter portion are spaced at irregular spacings. Several of the line segments 1278, 1282, 1284, 1288, 1292, 1296, and 1298 are of dissimilar lengths, and represent the irregular spacings between adjacent ones of the transmission lines 1204–1216 and 1220–1236. Such variance in the spacing between adjacent ones of the transmission lines may be selected to vary further the electrical characteristics of the filter portions, and, hence, the frequency responses of the filter portions of duplexer filter 1180.

Figure 9:
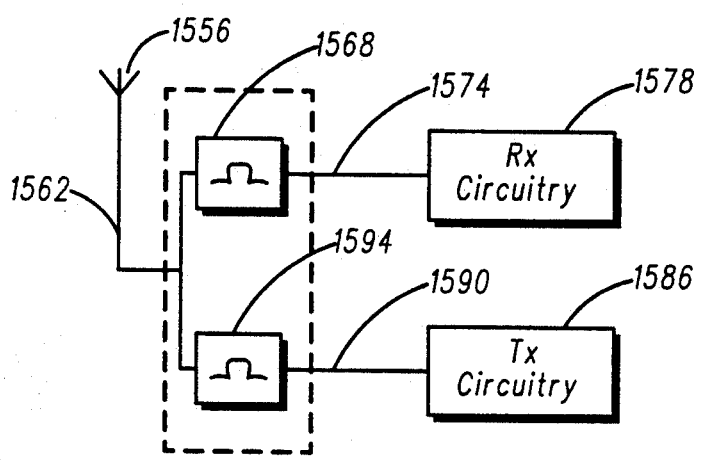
FIG. 9 is a block diagram of a radio transceiver of a preferred embodiment of the present invention in which a duplexer filter of a preferred embodiment of the present invention, such as a duplexer filter of one of the preceding figures, forms a portion.

FIG. 9 is a block diagram of a radio transceiver, such as a radiotelephone operative in a cellular, communication system, and referred to here generally by reference numeral 1550. Transceiver 1550 includes a duplexer such as a duplexer shown in one of the preceding figures as a portion thereof.

A signal transmitted to transceiver 1550 is received by antenna 1556, and a signal representative thereof is generated on line 1562 and applied to filter 1568. Filter 1568 corresponds to a first filter portion of the filter duplexer of one of the preceding figures. Filter 1568 generates a filtered signal on line 1574 which is applied to receiver circuitry 1578. Receiver circuitry 1578 performs functions such as down-conversion and demodulation of the received signal, as is conventional. Transmitter circuitry 1586 is operative to modulate and upconvert in frequency a signal to be transmitted by transceiver 1550, and to generate a signal on line 1590 which is applied to filter circuit 1594. Filter circuit 1594 corresponds to a second filter portion of one of the filter duplexer of the preceding figures and is operative to generate a filtered signal which is applied to antenna 1556 by way of line 1562 to be transmitted therefrom.

Figure 10:
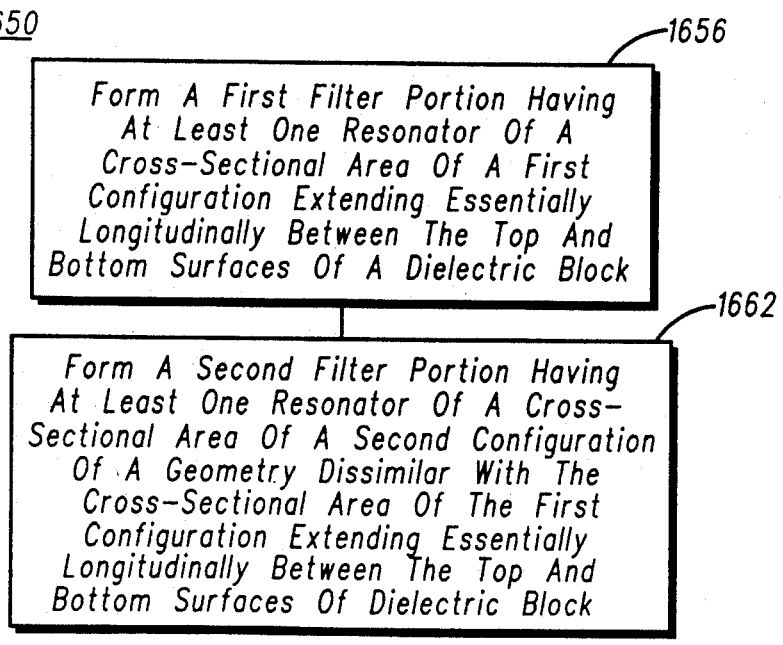
FIG. 10 is a logical flow diagram listing the method steps of the method of a preferred embodiment of the present invention.

Finally turning now to the logical flow diagram of FIG. 10, the method, referred to generally by reference numeral 1650, of a preferred embodiment of the present invention is shown. First, and as indicated by block 1656, a first filter circuit portion having at least one resonator of a cross-sectional area of a first configuration extending essentially longitudinally along a longitudinal axis thereof between the top and bottom surfaces of the dielectric block is formed. Next, and as indicated by block 1662, a second filter circuit portion having at least one resonator, of a cross-sectional area of a second configuration of a geometry dissimilar with the cross-sectional area of the first configuration is formed to extend essentially longitudinally along a longitudinal axis thereof between the top and bottom surfaces of the dielectric block.

While the present invention has been described in connection with the preferred embodiments shown in the various figures, it is to be understood that other similar embodiments may be used and modifications and additions may be made to the described embodiments for performing the same function of the present invention without deviating therefrom. Therefore, the present invention should not be limited to any single embodiment, but rather construed in breadth and scope in accordance with the recitation of the appended claims.

What is claimed is:

1. A multi-passband filter construction formed of a dielectric block defining top, bottom, and at least first and second side surfaces, said filter construction comprising:

a first filter circuit portion formed of a first portion of the dielectric block for generating a first filtered signal responsive to application of a first input signal thereto, the first filter circuit portion formed of at least one resonator defined by sidewalls of at least one cavity formed to extend essentially longitudinally along a longitudinal axis thereof between the top and bottom surfaces of the dielectric block the at least one resonator having a cross-section forming a closed curve of a first configuration;

a second filter circuit portion formed of a second portion of the dielectric block located adjacent to the first portion of the dielectric block of which the first filter circuit portion is formed, said second filter circuit portion for generating a second filtered signal responsive to application of a second input signal thereto, the second filter circuit portion formed of at least one resonator defined by sidewalls of at least one cavity formed to extend essentially longitudinally along a longitudinal axis thereof between the top and bottom surfaces of the dielectric block and having a cross-section forming a closed curve of a second configuration defined by a transverse axis extending in a direction transverse to the longitudinal axis wherein the cross-section of the second configuration is of a configuration dissimilar with that of the cross-section of the first configuration; and an electrically-conductive material coated upon the first and second side surfaces of the dielectric block and upon the sidewalls of the at least one resonator of the first and second filter circuit portions, respectively.

2. The filter construction of claim 1 further comprising means for coupling said electrically-conductive material to an electrical ground potential.

3. The filter construction of claim 1 further comprising a pattern of an electrically-conductive material coated upon the top surface of the dielectric block.

4. The filter construction of claim 1 wherein the cross-section of the first configuration comprises a circular cross-section of a first diameter and the cross-section of the second configuration comprises a circular cross-section of a second diameter.

5. The filter construction of claim 4 wherein the first diameter of the circular cross-section of the first configuration is of a length less than a length of the second diameter of the circular cross-section of the second configuration.

6. The filter construction of claim 1 wherein the cross-section of the first configuration comprises a circular cross-section of a first diameter and the cross-section of the second configuration comprises a cross-section elongated in a direction transverse to the longitudinal axis of the resonator formed to extend through the second filter circuit portion.

7. The filter construction of claim 6 wherein the cross-section of the first configuration defines an area greater in size than the cross-section of the second configuration.

8. The filter construction of claim 1 wherein the cross-section of the first configuration comprises a cross-section elongated in a direction transverse to the longitudinal axis of the resonator formed to extend through the first filter circuit portion and the cross-section of the second configuration comprises a circular cross-section.

9. The filter construction of claim 8 wherein the cross-section of the first configuration defines an area greater in size than the cross-section of the second configuration.

10. The filter construction of claim 1 wherein the cross-section of the first configuration is elongated by a first length in a direction transverse to the longitudinal axis of the resonator formed to extend through the first filter circuit portion and the cross-section of the second configuration is elongated by a second length in a direction transverse to the longitudinal axis of the resonator formed to extend through the second filter circuit portion.

11. The filter construction of claim 10 wherein the cross-section of the first configuration defines an area greater in size than the cross-section of the second configuration.

12. The filter construction of claim 1 wherein said at least one resonator of the first filter portion comprises a first resonator and a second resonator spaced-apart therefrom by a first, spaced-distance.

13. The filter construction of claim 12 wherein the first resonator extending through the first filter circuit portion is configured to form a filter-transfer function zero.

14. The filter construction of claim 12 wherein said at least one resonator of the second filter circuit portion comprises a first resonator and a second resonator spaced-apart therefrom by a second, spaced-apart distance.

15. The filter construction of claim 14 wherein the first resonator extending through the second filter circuit portion is configured to form a filter-transfer function zero.

16. The filter construction of claim 1 wherein the at least one resonator of the first filter circuit portion is of a first characteristic admittance, and the at least one resonator of the second filter circuit portion is of a second characteristic admittance.

17. A duplexer filter construction formed of a dielectric block defining top, bottom, and at least first and second side surfaces, said filter construction comprising:

a receive filter portion formed of a first portion of the dielectric block for generating a filtered, receive signal responsive to application of a receive signal thereto, the receive filter circuit portion formed of at least two, spaced-apart resonators defined by sidewalls of at least two cavities each formed to extend essentially longitudinally along longitudinal axes thereof between the top and bottom surfaces of the dielectric block, the at least two resonators each having cross-sections forming closed curves of first configurations;

a transmit filter circuit portion formed of a second portion of the dielectric block located adjacent to the first portion of the dielectric block of which the receive filter circuit is formed, said transmit filter circuit portion for generating a filtered, transmit signal responsive to application of a transmit signal thereto, the transmit filter circuit portion formed of at least two, spaced-apart resonators defined by sidewalls of at least two cavities, each formed to extend along longitudinal axes thereof between the top and bottom surfaces of the dielectric block, the at least two resonators each having cross-sections forming closed curves of second configurations wherein the cross-sections of the second configurations are of configurations dissimilar with those of the cross-sections areas of the first configurations; and an electrically-conductive material coated upon the first and second side surfaces of the dielectric block and upon the sidewalls of the at least one resonator of the first and second filter circuit portions, respectively.

18. In a radio transceiver having transmitter circuitry for generating a transmit signal and receiver circuitry for receiving a receive signal, a combination with the transmitter circuitry and the receiver circuitry of a duplexer filter construction formed of a dielectric block defining top, bottom, and at least first and second side surfaces, said filter construction comprising:

a receive filter portion formed of a first portion of the dielectric block for generating a filtered, receive signal responsive to application of the receive signal thereto, the receive filter portion formed of at least one resonator defined by sidewalls of at least one cavity formed to extend essentially longitudinally along a longitudinal axis thereof between the top and bottom surfaces of the dielectric block the at least one resonator having a cross-section forming a closed curve of a first configuration;

a transmit filter portion formed of a second portion of the dielectric block located adjacent to the first portion of the dielectric block of which the receive filter portion is formed, said transmit filter portion for generating a filtered, transmit signal responsive to application of the transmit signal thereto, the transmit filter portion formed of at least one resonator defined by sidewalls of at least one cavity formed to extend longitudinally along a longitudinal axis thereof between the top and bottom surfaces of the dielectric block and having a cross-section forming a closed curve of a second configuration, wherein the cross-section of the second configuration is of a configuration dissimilar with that of the cross-section of the first configuration; and an electrically-conductive material coated upon the first and second side surfaces of the dielectric block and upon the sidewalls of the at least one resonator of the first and second filter circuit portions, respectively.

19. A method for constructing a multi-passband filter of a block of dielectric material defining top, bottom, and at least first and second side surfaces, said method comprising the steps of:

forming a first filter circuit portion of a first portion of the dielectric block, the first filter circuit portion formed thereby having at least one resonator defined by sidewalls of at least one cavity extending essentially longitudinally along a longitudinal axis thereof between the top and bottom surfaces of the dielectric block and having at least one resonator of a cross-section forming a closed curve of a first configuration;

forming a second filter circuit portion of a second portion of the dielectric block located adjacent to the first portion of the dielectric block of which the first filter circuit portion is formed, the second filter circuit portion formed thereby having at least one resonator defined by sidewalls of at least one cavity extending essentially longitudinally along a longitudinal axis thereof between the top and bottom surfaces of the dielectric block and having a cross-section forming a closed curve of a second configuration wherein the cross-section of the second configuration is of a configuration dissimilar with that of the cross-section of the first configuration; and coating an electrically-conductive material upon the first and second side surfaces of the dielectric block and upon the sidewalls of the at least one resonator of the first and second filter circuit portions, respectively.

* * * * *